US010196726B2

(12) United States Patent
Azuma et al.

(10) Patent No.: US 10,196,726 B2
(45) Date of Patent: Feb. 5, 2019

(54) HIGH-STRENGTH HOT-ROLLED STEEL SHEET HAVING EXCELLENT BAKING HARDENABILITY AND LOW TEMPERATURE TOUGHNESS WITH MAXIMUM TENSILE STRENGTH OF 980 MPA OR MORE

(71) Applicant: NIPPON STEEL & SUMITOMO METAL CORPORATION, Tokyo (JP)

(72) Inventors: Masafumi Azuma, Tokyo (JP); Hiroshi Shuto, Tokyo (JP); Tatsuo Yokoi, Tokyo (JP); Yuuki Kanzawa, Tokyo (JP); Akihiro Uenishi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/653,787

(22) PCT Filed: Feb. 25, 2014

(86) PCT No.: PCT/JP2014/054570

§ 371 (c)(1),
(2) Date: Jun. 18, 2015

(87) PCT Pub. No.: WO2014/132968

PCT Pub. Date: Sep. 4, 2014

(65) Prior Publication Data

US 2015/0329950 A1 Nov. 19, 2015

(30) Foreign Application Priority Data

Feb. 26, 2013 (JP) ..... 2013-035597

(51) Int. Cl.

| | |
|---|---|
| ***C22C 38/00*** | (2006.01) |
| ***C23C 2/02*** | (2006.01) |
| ***C21D 8/02*** | (2006.01) |
| ***C23C 2/06*** | (2006.01) |
| ***C22C 38/38*** | (2006.01) |
| ***C22C 38/28*** | (2006.01) |
| ***C22C 38/26*** | (2006.01) |

(Continued)

(52) U.S. Cl.

CPC ..... *C23C 2/02* (2013.01); *C21D 8/021* (2013.01); *C21D 8/0226* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/26* (2013.01); *C22C 38/28* (2013.01); *C22C 38/38* (2013.01); *C23C 2/06* (2013.01); *C21D 2211/002* (2013.01); *C21D 2211/008* (2013.01)

(58) Field of Classification Search

CPC ..... C22C 38/38; C22C 38/28; C22C 38/26; C22C 38/16; C22C 38/14; C22C 38/12; C22C 38/08; C22C 38/00; C22C 38/001; C22C 38/002; C22C 38/005; C22C 38/02; C22C 38/04; C22C 38/06; C22C 38/18; C21D 2211/002; C21D 2211/008; C21D 8/021; C21D 8/0226; C21D 8/0263; C21D 9/46; C23C 2/02; C23C 2/06

See application file for complete search history.

(56) References Cited

U.S. PATENT DOCUMENTS 5,078,809 A 1/1992 Kinoshita et al.
6,264,760 B1 * 7/2001 Tamehiro et al. ..... 148/336
(Continued)

FOREIGN PATENT DOCUMENTS

CN 101696483 A 4/2010
CN 101910438 A 12/2010
(Continued)

OTHER PUBLICATIONS

International Search Report, dated May 20, 2014, issued in PCT/JP2014/054570.
Written Opinion of the International Searching Authority, dated May 20, 2014, issued in PCT/JP2014/054570.
Chinese Office Action and Search Report dated Apr. 18, 2016, for Chinese Application No. 201480007277.5 with the English translation of the Office Action.
Extended European Search Report dated May 6, 2016, for European Application No. 14756256.5.
(Continued)

*Primary Examiner* — Colleen P Dunn
*Assistant Examiner* — Anthony M Liang
(74) *Attorney, Agent, or Firm* — Birch, Stewart, Kolasch & Birch, LLP

(57) ABSTRACT

Provided is a high-strength hot-rolled steel sheet consisting of, in mass %, C: 0.01% to 0.2%, Si: 0% to 2.5%, Mn: 0% to 4.0%, Al: 0% to 2.0%, N: 0% to 0.01%, Cu: 0% to 2.0%, Ni: 0% to 2.0%, Mo: 0% to 1.0%, V: 0% to 0.3%, Cr: 0% to 2.0%, Mg: 0% to 0.01%, Ca: 0% to 0.01%, REM: 0% to 0.1%, B: 0% to 0.01%, P: less than or equal to 0.10%, S: less than or equal to 0.03%, O: less than or equal to 0.01%, one or both of Ti and Nb: 0.01% to 0.30% in total, and the balance being Fe and inevitable impurities. The steel sheet has a structure in which a total volume fraction of tempered martensite or lower bainite is 90% or more, a dislocation density thereof is greater than or equal to $5\times10^{13}$ ($1/m^2$) and less than or equal to $1\times10^{16}$ ($1/m^2$) and $1\times10^{6}$ (numbers/$mm^2$) or more iron-based carbides are included therein.

7 Claims, No Drawings

(51) Int. Cl.

| | |
|---|---|
| ***C21D 9/46*** | (2006.01) |
| ***C22C 38/14*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |

(56) References Cited

U.S. PATENT DOCUMENTS

| | | | | |
|---|---|---|---|---|
| 6,364,968 | B1 * | 4/2002 | Yasuhara et al. ..... | 148/320 |
| 2003/0084966 | A1 | 5/2003 | Ikeda et al. | |
| 2010/0000633 | A1 | 1/2010 | Yokoi et al. | |
| 2012/0031528 | A1 | 2/2012 | Hayashi et al. | |

FOREIGN PATENT DOCUMENTS

| | | | |
|---|---|---|---|
| CN | 102199722 | A | 9/2011 |
| JP | 2-57634 | A | 2/1990 |
| JP | 5-55586 | B2 | 8/1993 |
| JP | 10-280096 | A | 10/1998 |
| JP | 3404798 | B2 | 5/2003 |
| JP | 2003-247045 | A | 9/2003 |
| JP | 2004-300573 | A | 10/2004 |
| JP | 2006-161139 | A | 6/2006 |
| JP | 3822711 | B2 | 9/2006 |
| JP | 2006-274335 | A | 10/2006 |
| JP | 3860787 | B2 | 12/2006 |
| JP | 2008-144233 | A | 6/2008 |
| JP | 4362948 | B2 | 11/2009 |
| JP | 4524859 | B2 | 8/2010 |
| JP | 2011-17044 | A | 1/2011 |
| JP | 2011-52321 | A | 3/2011 |
| JP | 2012-12658 | A | 1/2012 |
| WO | WO 2009/082091 | A1 | 7/2009 |

OTHER PUBLICATIONS

Korean Office Action dated Jun. 29, 2016, for Korean Application No. 10-2015-7022664 with a partial English translation.

Chinese Office Action and Search Report for Chinese Application No. 201480007277.5, dated Dec. 6, 2016, with a partial English translation of the Office Action.

* cited by examiner

HIGH-STRENGTH HOT-ROLLED STEEL SHEET HAVING EXCELLENT BAKING HARDENABILITY AND LOW TEMPERATURE TOUGHNESS WITH MAXIMUM TENSILE STRENGTH OF 980 MPA OR MORE

TECHNICAL FIELD

The present invention relates to a high-strength hot-rolled steel sheet having excellent baking hardenability and low temperature toughness with a maximum tensile strength of 980 MPa or more, and a method for producing such a high-strength hot-rolled steel sheet. The present invention relates to a steel sheet having excellent hardening ability, after molding and coating-baking treatment, and excellent low temperature toughness to be able to be used in extremely cold areas.

BACKGROUND ART

To reduce the exhaust amount of carbon dioxide gas from automobiles, automobile bodies are being reduced in weight by using high-strength steel sheets. Furthermore, to secure the safety of drivers and passengers, in addition to soft steel sheets, more and more high-strength steel sheets with a maximum tensile strength of 980 MPa or more are becoming to be used for automobile bodies. To further reduce the weight of automobile bodies, the strength of high-strength steel sheets during use has to be higher than before. However, the increase in the strength of steel sheets typically leads to the degradation of material characteristics such as formability (processability). Thus, it is a key to the development of high-strength steel sheets how the strength is increased without the degradation of material characteristics.

Steel sheets that are used for such members are required to have such a performance that the members are unlikely to be damaged even when shocked by collision or the like after steel sheets are molded and attached to automobiles as components. In particular, in order to secure impact resistance in cold areas, low temperature toughness is also demanded to be increased. The low temperature toughness is defined by vTrs (Charpy fraction dislocation temperature), for example. For this reason, the impact resistance of the above steel materials needs to be considered. In addition, high-strength steel sheets are unlikely to be plastically deformed and will occur more easily; thus, toughness is demanded as significant characteristics.

As one of methods for increasing the strength of steel sheets without the degradation in formability, there is a method of baking-hardening using coating-baking. This method increases the strength of automobile members in the following manner: through heat treatment at the time of coating-baking treatment, dissolved C present in a steel sheet concentrates at dislocations formed during molding or is precipitated as carbides. Since hardening is performed after press formation in this method, there is no degradation in press formability due to the increase in strength. Thus, this method is expected to be used for automobile structural members. As an index for evaluation of the baking hardenability, there is known a testing method in which 2% prestrain is imparted at room temperature and then heat treatment is performed at 170° C. for 20 minutes to perform evaluation at the time of retensile testing.

Both the dislocations formed at the time of production and the dislocations formed at the time of press processing contribute to baking-hardening; therefore, the sum of them, which is the dislocation density, and the amount of dissolved C in the steel sheet, are important for the baking hardenability. An example of a steel sheet having excellent baking hardenability while having a large amount of dissolved C is the steel sheet shown in Patent Document 1 or 2. As a steel sheet that secures more excellent baking hardenability, there is known a steel sheet including N in addition to dissolved C and having excellent baking hardenability (Patent Documents 3 and 4).

Although the steel sheets shown in Patent Documents 1 to 4 can secure excellent baking hardenability, these steel sheets are not suitable for production of high-strength steel sheets with a maximum tensile strength of 980 or more that can contribute to high strength of structural members and the reduction in the weight because the base phase structure is a ferrite single phase.

In contrast, being extremely hard, a martensite structure is typically used as a main phase or the second phase in steel sheets having a strength as high as 980 MPa or more to increase the strength.

However, since martensite includes an enormous number of dislocations, it has been difficult to obtain excellent baking hardenability. This is because the dislocation density is high compared to the amount of dissolved C in steel. In general, when the amount of dissolved C is small compared to the dislocation density in a steel sheet, the baking hardenability is degraded. Accordingly, when soft steel that does not include many dislocations and steel of a martensite single phase are compared with each other, if the amount of dissolved C is the same, the baking hardenability of the martensite single phase is more degraded.

Therefore, as steel sheets that were attempted to secure more excellent baking hardenability, there are known steel sheets having higher strength by adding an element(s) such as Cu, Mo, W, and/or the like to steel and precipitating carbides of these elements at the time of baking-coating (Patent Documents 5 and 6). However, these steel sheets do not have high economic efficiency because the addition of expensive elements is necessary. In addition, even though carbides of these elements are used, it has been still difficult to secure the strength of 980 MPa or more.

Meanwhile, as for a method for increasing the toughness of a high-strength steel sheet, for example, Patent Document 7 discloses a method for producing such a steel sheet. There is known a method in which the aspect ratio of a martensite phase is adjusted the martensite phase is used as a main phase (Patent Document 7).

In general, it is known that the aspect ratio of martensite depends on the aspect ratio of austenite grains before transformation. That is, martensite having a high aspect ratio means martensite transformed from unrecrystallized austenite (austenite that is extended by rolling), and martensite having a low aspect ratio means martensite transformed from recrystallized austenite.

From the above description, in order to reduce the aspect ratio of the steel sheet of Patent Document 7, it is necessary to recrystallize austenite; in addition, in order to recrystallize austenite, it is necessary to increase the temperature of final rolling. Accordingly, the grain size of austenite and also the grain size of martensite have tended to be large. In general, grain refining is known to be effective to increase toughness. A reduction in the aspect ratio can reduce factors that degrade toughness due to the shape, but is accompanied the degradation of toughness due to coarse crystal grains; therefore, there is a limit on the increase in toughness. In addition, Patent Document 7 mentions nothing about the baking hardenability that a study of the present application has focused on, and Patent Document 7 hardly secures sufficient baking hardenability.

Furthermore, Patent Document 8 discloses that it is possible to increase the strength and low temperature toughness by finely precipitating carbides in ferrite having an average grain size of 5 to 10 μm. By precipitating dissolved C in steel as carbides including Ti and the like, the strength of the steel sheet is increased, so that it is considered that the amount of dissolved C in steel is small and excellent baking hardenability is unlikely to be obtained.

In this manner, it has been difficult for a high-strength steel sheet with 980 MPa or more to have both excellent baking hardenability and excellent low temperature toughness.

PRIOR ART DOCUMENTS

Patent Documents

[Patent Document 1] JP H5-55586B
[Patent Document 2] JP 3404798B
[Patent Document 3] JP 4362948B
[Patent Document 4] JP 4524859B
[Patent Document 5] JP 3822711B
[Patent Document 6] JP 3860787B
[Patent Document 7] JP 2011-52321A
[Patent Document 8] JP 2011-17044A

SUMMARY OF THE INVENTION

Problems to be Solved by the Invention

The present invention has been made in view of the above problems, and an object of the present invention is to provide a hot-rolled steel sheet having excellent baking hardenability and low temperature toughness with a maximum tensile strength of 980 MPa or more, and a method for producing such a steel sheet stably.

Means for Solving the Problem(s)

The present inventors have successfully produced a high-strength hot-rolled steel sheet having excellent baking hardenability and low temperature toughness with a maximum tensile strength of 980 MPa or more, by optimizing the composition of the steel sheet and conditions for producing the steel sheet and by controlling the structure of the steel sheet. A summary of the steel sheet is as follows.

(1)

A high-strength hot-rolled steel sheet with a maximum tensile strength of 980 MPa or more, the steel sheet having a composition consisting of, in mass %, C: 0.01% to 0.2%,
Si: 0% to 2.5%,
Mn: 0% to 4.0%,
Al: 0% to 2.0%,
N: 0% to 0.01%,
Cu: 0% to 2.0%,
Ni: 0% to 2.0%,
Mo: 0% to 1.0%,
V: 0% to 0.3%,
Cr: 0% to 2.0%,
Mg: 0% to 0.01%,
Ca: 0% to 0.01%,
REM: 0% to 0.1%,
B: 0% to 0.01%,
P: less than or equal to 0.10%,
S: less than or equal to 0.03%,
O: less than or equal to 0.01%,
one or both of Ti and Nb: 0.01% to 0.30% in total, and
the balance being Fe and inevitable impurities, wherein the steel sheet has a structure in which a total volume fraction of one or both of tempered martensite and lower bainite is 90% or more, and a dislocation density in the martensite and lower bainite is greater than or equal to $5\times10^{13}$ (1/m$^2$) and less than or equal to $1\times10^{16}$ (1/m$^2$).

(2)

The high-strength hot-rolled steel sheet according to (1), wherein the one or both of tempered martensite and lower bainite include $1\times10^6$ (numbers/mm$^2$) or more iron-based carbides.

(3)

The high-strength hot-rolled steel sheet according to (1), wherein the one or both of tempered martensite and lower bainite have an effective crystal size of less than or equal to 10 μm.

(4)

The high-strength hot-rolled steel sheet according to (1), including one or more of, in mass %, Cu: 0.01% to 2.0%,
Ni: 0.01% to 2.0%,
Mo: 0.01% to 1.0%,
V: 0.01% to 0.3%, and
Cr: 0.01% to 2.0%.

(5)

The high-strength hot-rolled steel sheet according to (1), including one or more of, in mass %, Mg: 0.0005% to 0.01%,
Ca: 0.0005% to 0.01%, and
REM: 0.0005% to 0.1%.

(6)

The high-strength hot-rolled steel sheet according to (1), including, in mass %, B: 0.0002% to 0.01%.

(7)

A method for producing a high-strength hot-rolled steel sheet with a maximum tensile strength of 980 MPa or more, the method including:

heating, optionally after cooling, a casting slab to a temperature of 1200° C. or more, the casing slab having a composition consisting of, in mass %, C: 0.01% to 0.2%,
Si: 0% to 2.5%,
Mn: 0% to 4.0%,
Al: 0% to 2.0%,
N: 0% to 0.01%,
Cu: 0% to 2.0%,
Ni: 0% to 2.0%,
Mo: 0% to 1.0%,
V: 0% to 0.3%,
Cr: 0% to 2.0%,
Mg: 0% to 0.01%,
Ca: 0% to 0.01%,
REM: 0% to 0.1%,
B: 0% to 0.01%,
P: less than or equal to 0.10%,
S: less than or equal to 0.03%,
O: less than or equal to 0.01%,
one or both of Ti and Nb: 0.01% to 0.30% in total, and
the balance being Fe and inevitable impurities;

completing hot rolling at a temperature of 900° C. or more;

cooling the steel sheet at a cooling speed of 50° C./s or more on average from a final rolling temperature to 400° C.;

setting a cooling speed of not more than 50° C./s at a temperature of less than 400° C.; and coiling the steel sheet.

(8)

The method for producing a high-strength hot-rolled steel sheet according to (7), further including:

performing galvanizing treatment or galvannealing treatment.

Effects of the Invention

According to the present invention, it becomes possible to provide a high-strength steel sheet having excellent baking hardenability and low temperature toughness with a maximum tensile strength of 980 MPa or more. By use of this steel sheet, it becomes easy to process the high-strength steel sheet, and also it becomes possible to use the processed high-strength steel sheet with high durability in extremely cold areas; thus, the industrial contribution of the high-strength steel sheet is very remarkable.

MODE(S) FOR CARRYING OUT THE INVENTION

The content of the present invention will be described below in detail.

According to the present inventors' intensive study, a structure of a steel sheet has a dislocation density of greater than or equal to $5\times10^{13}$ ($1/m^2$) and less than or equal to $1\times10^{16}$ ($1/m^2$), and includes one or both of tempered martensite and lower bainite, each including $1\times10^6$ (numbers/$mm^2$) or more iron-based carbides, in a total volume fraction of 90% or more. The present inventors have further found out that the effective crystal size of tempered martensite and lower bainite is preferably 10 μm or less so that a high strength of 980 MPa or more and excellent baking hardenability and low temperature toughness can be secured. Here, the effective crystal size means a region surrounded by grain boundaries having an orientation difference of 15° or more, which can be measured by using EBSD, for example. Details thereof will be described later.

[Microstructure of Steel Sheet]

First, a microstructure of a hot-rolled steel sheet according to the present invention will be described.

In this steel sheet, the main phase is one or both of tempered martensite and lower bainite in a total volume fraction of 90% or more, so that a maximum tensile strength of 980 MPa or more is secured. Accordingly, the main phase needs to be one or both of tempered martensite and lower bainite.

In the present invention, tempered martensite is the most important microstructure to have a high strength, excellent baking hardenability, and excellent low temperature toughness. Tempered martensite is an aggregation of lath-shaped crystal grains including, inside the lath, iron-based carbides having a major axis of 5 nm or more. In addition, these carbides belong to a plurality of variants, in other words, a plurality of iron-based carbides extending in different directions.

The structure of tempered martensite can be obtained by decreasing the cooling speed at the time of cooling performed at a temperature of less than or equal to Ms point (the temperature at which martensite transformation starts) or by making a martensite structure and then tempering it at 100° C. to 600° C. In the present invention, precipitation is controlled by cooling control at a temperature of less than 400° C.

Lower bainite is also an aggregation of lath-shaped crystal grains including, inside the lath, iron-based carbides having a major axis of 5 nm or more. In addition, these carbides belong to a single variant, in other words, a group of iron-based carbides extending in the same direction. Observation of the extending direction of carbides makes it easier to discriminate between tempered martensite and lower bainite. Here, the group of iron-based carbides extending in the same direction means that a difference in the extension direction in the group of iron-based carbides is within 5°.

When the total volume fraction of one or both of tempered martensite and lower bainite is less than 90%, a high maximum tensile strength of 980 MPa or more cannot be secured, and a maximum tensile strength of 980 MPa or more being one of requirements of the present invention cannot be secured. Accordingly, the lower limit of the total volume fraction of one or both of tempered martensite and lower bainite is 90%. On the other hand, even when the total volume fraction is 100%, the high strength, excellent baking hardenability, and excellent low temperature toughness, which are effects of the present invention, are shown.

In the structure of the steel sheet, as another structure, one or more of ferrite, fresh martensite, upper bainite, pearlite, and retained austenite may be contained in a total volume fraction of 10% or less as inevitable impurities.

Here, fresh martensite is defined as martensite that does not include carbides. Although fresh martensite has high strength, the low temperature toughness is poor; therefore, the volume fraction thereof needs to be limited to 10% or less. In addition, the dislocation density is extremely high and the baking hardenability is poor. Accordingly, the volume fraction thereof needs to be limited to 10% or less.

Retained austenite is transformed into fresh martensite when a steel material is plastically deformed at the time of press-formation or when an automobile member is plastically deformed at the time of collision, and thus, retained austenite has adverse effects similar to those of fresh martensite described above. Accordingly, the volume fraction needs to be limited to 10% or less.

Upper bainite is an aggregation of lath-shaped crystal grains, and is an aggregation of laths including carbides between laths. Carbides included between laths serve as a starting point of fracture, and decreases the low temperature toughness. In addition, since upper bainite is formed at higher temperatures than lower bainite, the strength is low, and excessive formation thereof makes it difficult to secure a maximum tensile strength of 980 MPa or more. This effect will become obvious if the volume fraction of upper bainite exceeds 10%, and accordingly, the volume fraction thereof needs to be limited to 10% or less.

Ferrite means a bulk of crystal grains and a structure not including, inside the structure, a lower structure such as a lath. Since ferrite is the softest structure and leads to a reduction in strength, in order to secure a maximum tensile strength of 980 MPa or more, it is necessary to have a limit being 10% or less. In addition, since ferrite is much softer than tempered martensite or lower bainite, which is included in the main phase, deformation concentrates at the interface between these structures to easily serve as a starting point of a fracture, resulting in poor low temperature toughness. These effects will become obvious if the volume fraction exceeds 10%; accordingly, the volume fraction thereof needs to be limited to 10% or less.

Pearlite leads to the decrease in strength and the degradation of low temperature toughness, in the same manner as ferrite; accordingly, the volume fraction thereof needs to be limited to 10% or less.

As for the steel sheet according to the present invention, which has the above described structure, the identification of tempered martensite, fresh martensite, bainite, ferrite, pearlite, austenite, and the balance included therein, the determination of existing positions, and measurement of area fractions can be performed by corroding a cross section in the steel sheet rolling direction or a cross section in a direction perpendicular to the rolling direction using a nital reagent and a reagent disclosed in JP S59-219473A, and then observing the steel sheet by a scanning and transmission-type electron microscope at a 1000 to 100000 magnification.

The discrimination of the structure is also possible by analysis of crystal orientations by a FESEM-EBSP method or measurement of the hardness of a micro-region such as micro-Vickers hardness measurement. For example, as described above, tempered martensite, upper bainite, and lower bainite are different from each other in the formation sites of carbides and relation of crystal orientations (extending directions). Thus, by observing iron-based carbides in the inside of lath-shaped crystal grains by a FE-SEM to examine extending directions thereof, it is possible to easily discriminate between bainite and tempered martensite.

In the present invention, the volume fractions of ferrite, pearlite, bainite, tempered martensite, and fresh martensite are obtained in the following manner: samples are extracted as observing surfaces by using cross sections in the sheet thickness direction, which is parallel to the rolling direction of the steel sheet; the observing surfaces are polished and etched by nital, and a range of ⅛ to ⅜ thickness centering ¼ of the sheet thickness is observed by a field emission scanning electron microscope (FE-SEM) to measure area fractions as the volume fractions. The measurement is performed on ten fields at a 5000 magnification for each sample, and an average is employed as the area fractions.

Since fresh martensite and retained austenite are not corroded sufficiently by nital etching, in the observation by the FE-SEM, it is possible to clearly discriminate between the above described structures (ferrite, bainitic ferrite, bainite, and tempered martensite). Accordingly, it is possible to obtain the volume fraction of fresh martensite as a difference between the area fraction of an uncorroded region observed by the FE-SEM and the area fraction of retained austenite measured by using X-rays.

The dislocation density in the structure of one or both of tempered martensite and lower bainite needs to be limited to $1\times10^{16}$ ($1/m^2$) or less. This is for obtaining excellent baking hardenability. In general, the density of dislocations existing in tempered martensite is high, so that excellent baking hardenability cannot be secured. Accordingly, by controlling cooling conditions in hot rolling, in particular, by setting the cooling speed at temperatures of less than 400° C. to less than 50° C./s, excellent baking hardenability can be obtained.

On the other hand, if the dislocation density is less than $5\times10^{13}$ ($1/m^2$), it will be difficult to secure a strength of 980 MPa or more, and accordingly, the lower limit of the dislocation density is set to $5\times10^{13}$ ($1/m^2$), desirably a value in a range from $8\times10^{13}$ to $8\times10^{15}$ ($1/m^2$), more desirably a value in a range from $1\times10^{14}$ to $5\times10^{15}$ ($1/m^2$).

The dislocation density may be obtained by observation using X-rays or a transmission-type electron microscope as long as the dislocation density can be measured. In the present invention, by thin film observation using an electron microscope, the dislocation density is measured. In the measurement, the film thickness of a measurement region is measured and then the number of dislocations existing in the volume is measured, so that the density is measured. The measurement is performed on ten fields at a 10000 magnification for each sample to calculate the dislocation density.

The one or both of tempered martensite and lower bainite according to the present invention desirably include $1\times10^6$ (numbers/$mm^2$) or more iron-based carbides. This is for increasing the low temperature toughness of the base phase and for obtaining a balance between the high strength and excellent low temperature toughness. That is, although quenched martensite without any further treatment has a high strength, the toughness thereof is poor and an improvement is needed. Accordingly, by precipitating $1\times10^6$ (numbers/$mm^2$) or more iron-based carbides, the toughness of the main phase is improved.

According to the present inventors' study on the relation between the low temperature toughness and the number density of iron-based carbides, it has been revealed that the excellent low temperature toughness can be secured by setting the number density of carbides in one or both of tempered martensite and lower bainite to $1\times10^6$ (numbers/$mm^2$) or more. Accordingly, the number density of carbides in one or both of tempered martensite and lower bainite is set to $1\times10^6$ (numbers/$mm^2$) or more, desirably $5\times10^6$ (numbers/$mm^2$) or more, more desirably $1\times10^7$ (numbers/$mm^2$) or more.

In addition, the size of carbides precipitated through the above treatment in the present invention is small, which is 300 nm or less, and most of the carbides are precipitated in the laths of martensite or bainite; accordingly, it is assumed that the low temperature toughness is not degraded.

The number density of carbides is measured in the following manner: samples are extracted as observing surfaces by using cross sections in the sheet thickness direction, which is parallel to the rolling direction of the steel sheet; the observing surfaces are polished and etched by nital, and a range of ⅛ to ⅜ thickness centering ¼ of the sheet thickness is observed by a field emission scanning electron microscope (FE-SEM). The measurement of the number density of iron-based carbides is performed on ten fields at a 5000 magnification for each sample.

In order to further increase the low temperature toughness, one or both of tempered martensite and lower bainite are included as the main phase, and in addition, the effective crystal size thereof is set to 10 μm or less. Effects of increasing the low temperature toughness become obvious by setting the effective crystal size to 10 μm or less; accordingly, the effective crystal size is set to 10 μm or less, desirably 8 μm or less. The effective crystal size mentioned here means a region surrounded by grain boundaries having a crystal orientation difference of 15° or more, which will be described later, and corresponds to a block grain size in martensite or bainite.

Next, methods for identifying an average crystal grain size and the structure will be described. In the present invention, the average crystal grain size, ferrite, and retained austenite are defined by using an electron back scatter diffraction pattern-orientation image microscopy (EBSP-OIM™). The method of EBSP-OIM™ is configured by an apparatus and software by which a highly inclined sample is irradiated with electron beams in a scanning electron microscope (SEM), Kikuchi patterns formed by back scattering are imaged by a high sensitivity camera, and computer image processing is performed to measure the crystal orientation of the irradiation point in a short period of time. In the EBSP method, it is possible to quantitatively analyze the microstructure and crystal orientations on the surface of the bulk sample, the analysis area is a region that can be observed by a SEM, and, depending on the resolution of the SEM, a resolution of a minimum of 20 nm can be analyzed. In the present invention, from an image mapped by defining the orientation difference in crystal grains as 15°, which is the threshold of high angle grain boundaries recognized commonly as crystal grain boundaries, grains are visualized and the average crystal grain size is obtained.

The aspect ratio of effective crystal grains (here, this means a region surrounded by grain boundaries of 15° or more) of tempered martensite and bainite is desirably 2 or less. Grains flattened in a specific direction have high anisotropy, and often have low toughness because cracks propagate along grain boundaries at the time of Charpy testing. Accordingly, it is necessary to make the effective crystal grains as isometric as possible. In the present invention, a cross section of the steel sheet in the rolling direction is observed, and a ratio (=L/T) of the length in the rolling direction (L) to the length in the sheet thickness direction (T) was defined as the aspect ratio.

[Chemical Composition of Steel Sheet]

Next, reasons for limits on the chemical composition of the high-strength hot-rolled steel sheet according to the present invention will be described. Note that % as the content means mass %.

C: 0.01% to 0.2%

C contributes to an increase in the strength of the base material and improvement in the baking hardenability, and also generates iron-based carbides such as cementite ($Fe_3C$), which serve as a starting point of breaking at the time of hole expansion. If the content of C is less than 0.01%, the effect of increasing the strength as a result of structure strengthening by a low temperature transformation generation phase cannot be obtained. If the content exceeds 0.2%, ductibility will be decreased and iron-based carbides such as cementite ($Fe_3C$), which serve as a starting point of breaking in a two-dimensional shear plane at the time of punching process, will be increased, resulting in the degradation of formability such as hole expandability. Therefore, the content of C is limited to the range from 0.01% to 0.2%.

Si: 0% to 2.5%

Si contributes to an increase in the strength of the base material and can be used as a deoxidant of molten steel. Accordingly, preferably 0.001% or more Si is contained as necessary. However, if the content exceeds 2.5%, the effect of contributing to the increase in strength will be saturated; accordingly, the content of Si is limited to 2.5% or less. In addition, when 0.1% or more Si is contained, as the content is increased, the precipitation of iron-based carbides such as cementite is more suppressed in the material structure, contributing to the increase in strength and hole expandability. If the content of Si exceeds 2.5%, the effect of suppressing the precipitation of iron-based carbides will be saturated. Therefore, the desirable range of the Si content is from 0.1% to 2.5%.

Mn: 0% to 4%

Mn can be contained so that the steel sheet structure can have a main phase of one or both of tempered martensite and lower bainite by, in addition to solution strengthening, quenching-hardening. If the addition is performed such that the content of Mn exceeds 4%, this effect will be saturated. On the other hand, if the Mn content is less than 1%, effects of suppressing ferrite transformation and bainite transformation will not be shown easily during cooling. Accordingly, the content of Mn is desirably 1% or more, more desirably from 1.4% to 3.0%.

One or Both of Ti and Nb: 0.01% to 0.30% in Total

Each of Ti and Nb is the most important constituent element in order to realize both the excellent low temperature toughness and the high strength of 980 MPa or more. Carbonitrides thereof or dissolved Ti and Nb delay the growth of grains at the time of hot rolling, thereby contributing to refinement of the grain size of a hot rolled sheet and the increase in the low temperature toughness. Dissolved N is important because dissolved N promotes the growth of grains. At the same time, Ti is particularly important because Ti can exist as TiN to contribute to the increase in the low temperature toughness through the refinement of the grain size at the time of heating the slab. In order to obtain a grain size of the hot rolled sheet being 10 μm or less, 0.01% or more Ti and Nb, alone or in combination, needs to be contained. If the total content of Ti and Nb exceeds 0.30%, the above effect will be saturated and the economic efficiency will be lowered. Therefore, the content of Ti and Nb in total is desirably the range from 0.02% to 0.25%, more desirably the range from 0.04% to 0.20%.

Al: 0% 2.0%

Al may be contained because Al suppresses the formation of coarse cementite and increases the low temperature toughness. In addition, Al can be used as a deoxidant. However, excessive Al will increase the number of Al-based coarse inclusions, resulting in the degradation of hole expandability and surface scratches. Therefore, the upper limit of the Al content is 2.0%, desirably 1.5%. Since it is difficult to contain 0.001% or less Al, this is a substantial lower limit.

N: 0% to 0.01%

N may be contained because N increases the baking hardenability. However, N might lead to the formation of blowholes at the time of welding, which might decrease the strength of joints of welded parts. Accordingly, the content of N needs to be 0.01% or less. On the other hand, the content of N being 0.0005% or less is not economically efficient, and therefore, the content of N is desirably 0.0005% or more.

The above elements are the basic chemical composition of the hot rolled steel sheet according to the present invention, and the following composition may be further contained.

One or more of Cu, Ni, Mo, V, and Cr may be contained because these elements suppress ferrite transformation at the time of cooling and change the steel sheet structure into one or both of a tempered martensite structure and a lower bainite structure. In addition, one or more of these elements may be contained because these elements have an effect of increasing the strength of the hot rolled steel sheet by precipitation strengthening or solution strengthening. However, if the content of each of Cu, Ni, Mo, V, and Cu is less than 0.01%, the above effects will not be shown sufficiently. In addition, if the content of Cu exceeds 2.0%, the content of Ni exceeds 2.0%, the content of Mo exceeds 1.0%, the content of V exceeds 0.3%, and the content of Cr exceeds 2.0%, the above effects will be saturated and the economic efficiency will be lowered. Therefore, it is desirable that, in a case where one or more of Cu, Ni, Mo, V, and Cr are contained as necessary, the contents of Cu, Ni, Mo, V, and Cr range from 0.01% to 2.0%, from 0.01% to 2.0%, from 0.01% to 1.0%, from 0.01% to 0.3%, and from 0.01% to 2.0%, respectively.

One or more of Mg, Ca, and REM (rare earth metal) may be contained because these elements control the form of non-metal inclusions serving as a starting point of fracture and a factor of the degradation of processability so as to increase processability. When the total content of Ca, REM, and Mg is 0.0005%, the effects will be obvious. Accordingly, in a case where one or more of these elements are contained, the total content thereof needs to be 0.0005% or more. In addition, if the content of Mg exceeds 0.01%, the content of Ca exceeds 0.01%, and the content of REM exceeds 0.1%, the above effects will be saturated and the economic efficiency is lowered. Therefore, it is desirable that the content of Mg, the content of Ca, and the content of REM range from 0.0005% to 0.01%, from 0.0005% to 0.01%, and from 0.0005% to 0.1%, respectively.

B contributes to the change of the steel sheet structure into one or both of a tempered martensite structure and a lower bainite structure by delaying ferrite transformation. In addition, in the same manner as C, by segregating B in the grain boundaries to increase the grain boundary strength, the low temperature toughness is increased. Thus, B may be contained in the steel sheet. However, this effect becomes obvious when the content of B in the steel sheet is 0.0002% or more; accordingly, the lower limit thereof is desirably 0.0002%. On the other hand, if the content of B exceeds 0.01%, the effect is saturated and the economic efficiency is lowered; accordingly, the upper limit is 0.01%. The content of B is desirably in the range from 0.0005% to 0.005%, more desirably from 0.0007% to 0.0030%.

As for the other elements, even when one or more of Zr, Sn, Co, Zn, and W are contained in a total content of 1% or less, the effects of the present invention are confirmed to not be damaged. Among these elements, Sn might generate scratches at the time of hot-rolling; accordingly, the content thereof is desirably 0.05% or less.

In the present invention, the composition other than the above is Fe, but inevitable impurities that are mixed from raw materials for melting such as scraps or refractories are acceptable. Typical impurities are as follows.

P: 0.10% or Less

P, which is an impurity contained in molten pig iron, is segregated in the grain boundaries, and as the content thereof is increased, the low temperature toughness is decreased more. Accordingly, the content of P is desirably as low as possible, and is 0.10% or less because the content being more than 0.10% will adversely affect the processability and weldability. In particular, considering weldability, the content of P is desirably 0.03% or less. The lower the content of P is, the more preferable it is; however, a reduction more than necessary will burden a steelmaking process with a heavy load. Accordingly, the lower limit of the content of P may be 0.001%.

S: 0.03% or Less

S is also an impurity contained in molten pig iron. If the content of S is too high, breaking will be generated at the time of hot rolling, and also inclusions such as MnS, which degrades hole expandability, will be generated. Accordingly, the content of S should be as low as possible, and 0.03% or less is within an acceptable range. Therefore, the content of S is 0.03% or less. Note that, in a case where a certain hole expandability is necessary, the content of S is preferably 0.01% or less, more preferably 0.005% or less. The lower the content of S is, the more preferable it is; however, a reduction more than necessary will burden a steelmaking process with a heavy load. Accordingly, the lower limit of the content of S may be 0.0001%.

O: 0.01% or Less

Too much O generates coarse oxides serving as a starting point of fracture in steel and causes brittle fracture or hydrogen induced cracking, so that the content of O is 0.01 or less. For on-site weldability, the content of O is desirably 0.03% or less. The content of O may be 0.0005% or more because O disperses a large number of fine oxides at the time of deoxidation of molten steel.

The high-strength hot-rolled steel sheet according to the present invention, which has the above described structure and chemical composition, can have high corrosion resistance by including, on a surface thereof, a hot dip galvanized layer formed by hot dip galvanizing treatment and a galvannealed layer formed by galvannealing treatment (galvannealing treatment means treatment using a hot-dip plating process and an alloying process). Note that the plated layer is not limited to pure zinc, and any of the elements such as Si, Mg, Zn, Al, Fe, Mn, Ca, and Zr may be added so as to further increase the corrosion resistance. Inclusion of such a plated layer does not damage the excellent baking hardenability and low temperature toughness of the present invention.

Alternatively, the effects of the present invention can be shown by including a surface-treating layer formed by any of the following: formation of an organic film, film laminating, organic salts/inorganic salts treatment, non-chromium treatment, and the like.

[Method for Producing Steel Sheet]

Next, a method for producing the steel sheet according to the present invention will be described.

In order to achieve the excellent baking hardenability and low temperature toughness, it is important that the dislocation density is $1\times10^{16}$ ($1/m^2$) or less, the number of iron-based carbides is $1\times10^{6}$ (numbers/$mm^2$) or more, and the total content of one or both of tempered martensite and lower bainite, each of which has a grain size of 10 μm or less, is 90% or more. Details of production conditions for satisfying all of the above conditions will be described below.

There is no particular limitation on the production method before hot rolling. That is, subsequently to melting in a blast furnace, electric furnace, or the like, secondary refining is performed in a various manner so that the composition is adjusted to be the above composition, followed by casting by normal continuous casting, an ingot method, thin slab casting, or the like.

In a case of continuous casting, cooling may be performed to make the temperature low and then reheating may be performed before hot rolling, an ingot may be hot-rolled without cooling to room temperature, or a casting slab may be hot-rolled continuously. As long as the composition can be controlled within the range according to the present invention, scraps may be used as a raw material.

The high-strength steel sheet according to the present invention is obtained when the following requirements are satisfied.

To produce the high-strength steel sheet, melting is performed to obtain a predetermined steel sheet composition, and then optionally after cooling, a casting slab is heated to a temperature of 1200° C. or more, hot-rolling is completed at a temperature of 900° C. or more, the steel sheet is cooled at a cooling speed of 50° C./s or more on average from a final rolling temperature to 400° C. and the steel sheet is coiled at a temperature of less than 400° C. and a cooling speed of not more than 50° C./s. In this manner, it is possible to produce a high-strength hot-rolled steel sheet having excellent baking hardenability and low temperature toughness with a maximum tensile strength of 980 MPa or more.

The temperature for heating the slab in hot rolling needs to be 1200° C. or more. In the steel sheet according to the present invention, austenite grains are prevented from being coarse by using dissolved Ti and Nb, and accordingly, it is necessary to dissolve NbC and TiC that have been precipitated at the time of casting. If the temperature for heating the slab is less than 1200° C., carbides of Nb and Ti will take a long time to be melted, and thus the crystal grain size will not be refined thereafter and the effect of increasing the low temperature toughness caused by the refinement will not be shown. Therefore, the temperature for heating the slab needs to be 1200° C. or more. The effect of the present invention can be shown even without any particular upper limit on the temperature for heating the slab; however, excessively high temperature for heating is not economically efficient. Therefore, the upper limit on the temperature for heating the stab is desirably less than 1300° C.

The final rolling temperature needs to be 900° C. or more. Large numbers of Ti and Nb are added to the steel sheet according to the present invention in order to refine the grain size of austenite. Accordingly, if the final rolling is performed in a temperature range of less than 900° C., austenite will be unlikely to be recrystallized and grains extending in the rolling direction will be generated, easily causing the degradation of toughness. Furthermore, when unrecrystallized austenite is transformed into martensite or bainite, dislocations accumulated in austenite are inherited to martensite or bainite, so that the dislocation density in the steel sheet cannot be within the range regulated in the present invention, resulting in the degradation of baking hardenability. Therefore, the final rolling temperature is 900° C. or more.

It is necessary to perform cooling at an average cooling speed of 50° C./s or more from the final rolling temperature to 400° C. If the cooling speed is less than 50° C./s, ferrite will be formed halfway on the cooling, and it will become difficult to make the volume ratio of the main phase, one or both of tempered martensite and lower bainite, be 90% or more. Accordingly, the average cooling speed needs to be 50° C./s or more. However, if ferrite is not formed during the cooling process, air cooling may be performed at temperatures from the final rolling temperature to 400° C.

Note that it is preferable to set the cooling speed from a Bs point to the temperature at which the lower bainite is generated (hereinafter referred to as lower bainite generating temperature) to 50° C./s or more. This is for avoiding the formation of upper bainite. If the cooling speed from the Bs point to the lower bainite generating temperature is less than 50° C./s, the upper bainite will be generated; furthermore, fresh martensite (martensite having a high dislocation density) will be generated between laths of bainite, or retained austenite (will be transformed into martensite having a high dislocation density at the time of processing) will exist, resulting in the degradation of baking hardenability and low temperature toughness. Note that the Bs point is the temperature at which upper bainite is started to be generated, the temperature being defined depending on the composition, and is 550° C. for convenience. Although also defined depending on the composition, the lower bainite generating temperature is 400° C. for convenience. From the final rolling temperature to 400° C., the average cooling speed is set to 50° C./s or more, and the cooling speed especially from 550° C. to 400° C. is set to 50° C./s or more.

Note that setting the average cooling speed to 50° C./s or more from the final rolling temperature to 400° C. includes the case where the cooling speed is set to 50° C./s or more from the final rolling temperature to 550° C. and the cooling speed is set to less than 50° C./s from 550° C. to 400° C. However, under this condition, upper bainite is easily generated, and greater than 10% upper bainite might be partially generated. Accordingly, it is preferable to set the cooling speed to 50° C./s or more from 550° C. to 400° C.

The maximum cooling speed at temperatures of less than 400° C. needs to be less than 50° C./s. This is for making a main phase of one or both of tempered martensite and lower bainite in which the dislocation density and the number density of iron-based carbides are set to within the above range. If the maximum cooling speed is 50° C./s or more, the iron-based carbides and the dislocation density will not be within the above range, and excellent baking hardenability and toughness are not obtained. Thus, the maximum cooling speed needs to be less than 50° C./s.

Here, cooling at temperatures of less than 400° C. and a cooling speed of not more than 50° C./s is achieved by air cooling, for example. The cooling here not only means cooling but also includes coiling the steel sheet in isothermal holding, that is, coiling at temperatures of less than 400° C. Furthermore, the cooling speed is controlled in this temperature range in order that the dislocation density and the number density of iron-based carbides in the steel sheet structure are controlled. Thus, after cooling is performed such that the temperature becomes the temperature at which martensite transformation starts (Ms point) or less, even when the temperature is increased and reheating is performed, it is still possible to obtain a maximum tensile strength of 980 MPa or more, excellent baking hardenability, and excellent toughness, which are the effects of the present invention.

In general, ferrite transformation needs to be suppressed to obtain martensite, and cooling at 50° C./s or more is said to be necessary. In addition, at low temperatures, dislocations occur from a temperature range called film boiling range in which the heat transfer coefficient is relatively low and cooling is difficult, to a temperature range called nucleate boiling temperature range in which the heat transfer coefficient is high and cooling is easy. In a case where the cooling is stopped at a temperature range of less than 400° C., the coiling temperature is likely to vary, and accordingly, the material quality varies. Thus, typically, the coiling temperature has often been set to temperatures greater than 400° C. or to room temperature.

As a result, it is assumed that it has not been found out in the related art that the coiling at temperatures of less than 400° C. or the decrease in cooling speed can lead to a maximum tensile strength of 980 MPa or more, excellent baking hardenability, and excellent temperature toughness.

Note that, in order to increase ductility by the correction of the steel sheet and formation of movable dislocations, after all the steps are finished, skin-pass rolling is desirably performed at a reduction of from 0.1% to 2%. In addition, after all the steps are finished, in order to remove scales attached onto the surface of the thus obtained hot-rolled steel sheet, the hot-rolled steel sheet may be pickled as necessary. Furthermore, after pickling, the resulting hot-rolled steel sheet may be subjected to skin-pass or cold rolling at a reduction of 10% or less in an in-line or off-line manner.

The steel sheet of the present invention is produced through continuous casting, rough rolling, final rolling, or pickling, which are a typical hot-rolling process; however, even when part of them is omitted in the production, the effects of the present invention, which are a maximum tensile strength of 980 MPa or more, excellent baking hardenability, and excellent low temperature toughness, can be secured.

In addition, after the hot-rolled steel sheet is produced, even when heat treatment is performed in a temperature range from 100° C. to 600° C. in an in-line or off-line manner in order to precipitate carbides, the effects of the present invention, which are excellent baking hardenability, excellent low temperature toughness, and a maximum tensile strength of 980 MPa or more, can be secured.

The steel sheet having a maximum tensile strength of 980 MPa or more in the present invention means a steel sheet having 980 MPa or more maximum tensile stress measured by tensile testing in conformity to JIS Z 2241 using JIS No. 5 test piece that is cut out in a direction perpendicular to the rolling direction of hot rolling.

The steel sheet having excellent baking hardenability in the present invention means a steel sheet having 60 MPa or more, desirably 80 MPa or more, difference in yield strength at the time of retensile testing after 2% tensile prestrain is imparted, followed by heat treatment at 170° C. for 20 minutes. The above difference corresponds to baking hardenability (BH) measured in conformity with coating-baking-hardening testing methods described in an appendix of JIS G 3135.

The steel sheet having excellent toughness at low temperatures in the present invention means a steel sheet having −40° C. fraction dislocation temperature (vTrs) measured by Charpy testing conducted in conformity with JIS Z 2242. In the present invention, since the target steel sheet is mainly used for automobile application, the thickness is typically about 3 mm. Thus, the surface of the hot-rolled steel sheet is grinded and the steel sheet is processed into a 2.5-mm sub-size test piece.

EXAMPLES

The technical content of the present invention will be described by taking Examples of the present invention.

As Examples, inventive steels A to S satisfying the conditions of the present invention and comparative steels a to k, component compositions of which are shown in Table 1, and results of studies thereof will be described.

After these steels were casted, directly the steels were heated to a temperature range of from 1030° C. to 1300° C., or the steels were cooled to room temperature and then reheated to this temperature range. Then, hot rolling was performed under conditions shown in Tables 2-1 and 2-2, final rolling was performed at temperatures of from 760° C. to 1030° C., and cooling and coiling were performed under conditions shown in Tables 2-1 and 2-2. Thus, hot-rolled steel sheets having a thickness of 3.2 mm were produced. Then, pickling was performed and 5% skin-pass rolling was performed.

Various test pieces were cut out from the thus obtained hot-rolled steel sheets to perform material quality testing and structure observation.

Tensile testing was conducted by cutting out JIS No. 5 test pieces in a direction perpendicular to the rolling direction, in conformity with JIS Z 2242.

The baking hardenability was measured by cutting out JIS No. 5 test pieces in a direction perpendicular to the rolling direction, in conformity with a coating-baking-hardening testing method described in an appendix of JIS G 3135. The prestrain was 2% and the heat treatment conditions were 170° C.×20 minutes.

Charpy testing was conducted in conformity with JIS Z 2242, and fracture dislocation temperatures were measured. Since each of the steel sheets of the present invention had a thickness of less than 10 mm, both surfaces of the hot-rolled steel sheet were grinded to be 2.5 mm in thickness, and then the Charpy testing was conducted.

Some of the steel sheets were obtained as hot-dip-galvanized steel sheet (GI) and galvannealed steel sheet (GA) by heating the hot-rolled steel sheet to 660° C. to 720° C., and performing hot dip galvanizing treatment or plating treatment followed by alloying heat treatment at 540° C. to 580° C., so that the material quality testing was conducted.

Micro-structure observation was performed by the above method, and each structure was measured for volume fraction, dislocation density, the number density of iron-based carbides, effective crystal size, and aspect ratio.

Tables 3-1 and 3-2 show the results.

It is clear that only the steels satisfying the conditions of the present invention had a maximum tensile strength of 980 MPa or more, excellent baking hardenability, and excellent low temperature toughness.

In contrast, steels A-3, B-4, E-4, J-4, M-4, and S-4 were not able to have the structure fraction and effective crystal size within the range of the present invention, and had lower strength and poor low temperature toughness because carbides of Ti and Nb that were precipitated at the time of casting are unlikely to be dissolved due to the temperature for heating the slab being less than 1200° C., even though the other hot-rolling conditions were within the range of the present invention.

Steels A-4, B-5, J-5, M-5, and S-5 were formed at too low final rolling temperature, so that rolling was performed in a range of unrecrystallized austenite. Accordingly, the dislocation density in the hot-rolled sheet became too high and the baking hardenability became poor, and in addition, the grains were extended in the rolling direction and the aspect ratio was high. Therefore, the steels A-4, B-5, J-5, M-5, and S-5 had a high aspect ratio and poor toughness.

Steels A-5, B-6, J-6, M-6, and S-6 were formed at a cooling speed of less than 50° C./s from the final rolling temperature to 400° C., so that a large amount of ferrite was formed during cooling. Accordingly, high strength was hardly secured and the interface between ferrite and martensite served as a starting point of fracture. Therefore, the steels A-5, B-6, J-6, M-6, and S-6 had poor low temperature toughness.

Steels A-6, B-7, J-7, M-7, and S-7 were formed at a maximum cooling speed of 50° C./s or more at temperatures of less than 400° C., so that the dislocation density in martensite became high and the baking hardenability became poor. In addition, the precipitation amount of carbides was insufficient, and therefore the steels A-6, B-7, J-7, M-7, and S-7 had poor low temperature toughness Note that, in the steel B-3 in Examples, in a case where the cooling speed was set to 45° C./s from 550° C. to 400° C., the average cooling speed was 80° C./s from 950° C., which is the final rolling temperature, to 400° C. Therefore, the average cooling speed of 50° C. or more was satisfied; however, the steel sheet structure included 10% or more upper bainite partially, and the material quality thereof varied.

A steel A-7 was formed at a coiling temperature as high as 480° C., so that the steel sheet structure became an upper bainite structure. Accordingly, a maximum tensile strength of 980 MPa or more was hardly obtained and coarse iron-based carbides precipitated between laths existing in the upper bainite structure served as a starting point of fracture. Therefore, the steel A-7 had poor low temperature toughness.

Steels B-8, J-8, and M-8 were formed at coiling temperatures as high as from 580° C. to 620° C., so that the steel sheet structure became a mixed structure of ferrite and pearlite including carbides of Ti and Nb. Accordingly, most of C in the steel sheet was precipitated as carbides, and a sufficient amount of dissolved C was not secured. Therefore, the steels B-8, J-8, and M-8 had poor baking hardenability.

In addition, as shown in steels A-8, A-9, B-9, B-10, E-6, E-7, J-9, J-10, M-9, M-10, S-9 and S-10, even when galvannealing treatment or galvannealing treatment is performed, the material quality of the present invention can be secured.

In contrast, the steels a to k whose steel sheet components were not within the range of the present invention were not able to have a maximum tensile strength of 980 MPa or more, excellent baking hardenability, and excellent low temperature toughness, as defined in the present invention.

TABLE 1

| Steel | C | Si | Mn | P | S | Al | N | O | Ti | Nb | Others | Note |
|---|---|---|---|---|---|---|---|---|---|---|---|---|
| A | 0.054 | 1.32 | 2.34 | 0.009 | 0.0009 | 0.029 | 0.0024 | 0.0022 | 0.192 | — | — | Inv. Steel |
| B | 0.063 | 1.16 | 2.91 | 0.012 | 0.0024 | 0.033 | 0.0021 | 0.0016 | 0.103 | 0.021 | — | Inv. Steel |
| C | 0.069 | 0.76 | 2.31 | 0.015 | 0.0023 | 0.024 | 0.0021 | 0.0016 | 0.062 | 0.031 | Cu = 0.23 | Inv. Steel |
| D | 0.070 | 0.59 | 2.39 | 0.007 | 0.0016 | 0.018 | 0.0029 | 0.0020 | 0.049 | 0.039 | Ni = 0.42 | Inv. Steel |
| E | 0.068 | 0.72 | 1.89 | 0.010 | 0.0038 | 0.016 | 0.0027 | 0.0023 | — | 0.087 | Mo = 0.38 | Inv. Steel |
| F | 0.059 | 1.76 | 2.42 | 0.008 | 0.0043 | 0.011 | 0.0026 | 0.0015 | 0.024 | 0.016 | V = 0.046 | Inv. Steel |
| G | 0.068 | 1.06 | 1.78 | 0.006 | 0.0012 | 0.032 | 0.0025 | 0.0027 | 0.101 | — | Cr = 0.62 | Inv. Steel |
| H | 0.082 | 0.64 | 2.28 | 0.009 | 0.0005 | 0.006 | 0.0027 | 0.0021 | 0.089 | — | Mg = 0.0014 | Inv. Steel |
| I | 0.060 | 0.54 | 2.30 | 0.014 | 0.0038 | 0.010 | 0.0032 | 0.0016 | 0.102 | — | Ca = 0.0008 | Inv. Steel |
| J | 0.073 | 0.08 | 2.53 | 0.018 | 0.0026 | 1.080 | 0.0072 | 0.0009 | 0.052 | 0.012 | B = 0.0028 | Inv. Steel |
| K | 0.070 | 0.84 | 2.32 | 0.007 | 0.0019 | 0.020 | 0.0016 | 0.0018 | 0.027 | 0.011 | REM = 0.0038 | Inv. Steel |
| L | 0.103 | 0.89 | 2.27 | 0.009 | 0.0030 | 0.017 | 0.0030 | 0.0016 | 0.086 | — | — | Inv. Steel |
| M | 0.109 | 0.92 | 2.07 | 0.012 | 0.0024 | 0.034 | 0.0320 | 0.0022 | 0.049 | 0.025 | B = 0.0013 | Inv. Steel |
| N | 0.107 | 0.85 | 1.64 | 0.011 | 0.0027 | 0.016 | 0.0016 | 0.0018 | 0.099 | — | Cr = 1.26 | Inv. Steel |
| O | 0.111 | 0.69 | 2.31 | 0.016 | 0.0007 | 0.010 | 0.0027 | 0.0021 | 0.095 | — | Ca = 0.0022 | Inv. Steel |
| P | 0.114 | 0.13 | 1.89 | 0.012 | 0.0025 | 0.642 | 0.0026 | 0.0012 | 0.071 | 0.016 | Mo = 0.19, B = 0.0009 | Inv. Steel |
| Q | 0.157 | 1.22 | 2.34 | 0.010 | 0.0018 | 0.030 | 0.0030 | 0.0023 | 0.048 | 0.009 | B = 0.0009 | Inv. Steel |
| R | 0.161 | 1.08 | 2.31 | 0.009 | 0.0021 | 0.028 | 0.0024 | 0.0018 | 0.062 | — | — | Inv. Steel |
| S | 0.200 | 0.87 | 2.11 | 0.013 | 0.0032 | 0.020 | 0.0023 | 0.0021 | 0.067 | 0.002 | Cr = 0.29 | Inv. Steel |
| a | 0.002 | 0.34 | 1.32 | 0.062 | 0.0056 | 0.034 | 0.0033 | 0.0032 | 0.019 | 0.042 | — | Comp. Steel |
| b | 0.620 | 1.32 | 2.16 | 0.013 | 0.0034 | 0.024 | 0.0021 | 0.0017 | 0.021 | 0.029 | — | Comp. Steel |
| c | 0.084 | 3.09 | 2.34 | 0.021 | 0.0029 | 0.029 | 0.0023 | 0.0016 | 0.086 | 0.012 | — | Comp. Steel |
| d | 0.072 | 0.86 | 5.61 | 0.032 | 0.0032 | 0.021 | 0.0019 | 0.0021 | 0.105 | — | — | Comp. Steel |
| f | 0.063 | 0.84 | 2.13 | 0.109 | 0.0018 | 0.034 | 0.0035 | 0.0018 | 0.079 | 0.024 | — | Comp. Steel |
| g | 0.065 | 0.73 | 1.89 | 0.018 | 0.0510 | 0.013 | 0.0031 | 0.0020 | 0.099 | 0.013 | — | Comp. Steel |
| h | 0.073 | 0.69 | 1.99 | 0.008 | 0.0016 | 2.462 | 0.0030 | 0.0043 | 0.104 | 0.011 | — | Comp. Steel |
| i | 0.084 | 0.75 | 2.05 | 0.013 | 0.0025 | 0.046 | 0.0490 | 0.0026 | 0.076 | 0.020 | — | Comp. Steel |
| j | 0.091 | 0.81 | 2.13 | 0.016 | 0.0036 | 0.023 | 0.0025 | 0.0027 | — | — | — | Comp. Steel |
| k | 0.076 | 0.82 | 1.97 | 0.009 | 0.0045 | 0.034 | 0.0029 | 0.0023 | 0.406 | 0.023 | — | Comp. Steel |

Ranges beyond the present invention are underlined.

TABLE 2-1

| Steel | Temperature for heating slab (° C.) | Final rolling temperature (° C.) | Average cooling speed from final to 400° C. (° C./s) | Cooling speed from 550° C. to 400° C. (° C./s) | Maximum cooling speed at less than 400° C. (° C./s) | Coiling temperature (° C.) | Note |
|---|---|---|---|---|---|---|---|
| A-1 | 1240 | 960 | 50 | 73 | 40 | Room temp. | Inv. Steel |
| A-2 | 1230 | 940 | 50 | 73 | <0.1 | 330 | Inv. Steel |
| A-3 | 1030 | 910 | 100 | 123 | 30 | Room temp. | Comp. Steel |
| A-4 | 1240 | 820 | 70 | 93 | 35 | Room temp. | Comp. Steel |
| A-5 | 1230 | 940 | 20 | 43 | 20 | Room temp. | Comp. Steel |
| A-6 | 1220 | 960 | 70 | 93 | 120 | Room temp. | Comp. Steel |
| A-7 | 1250 | 970 | 50 | 73 | <0.1 | 480 | Comp. Steel |
| A-8 | 1240 | 950 | 60 | 83 | 40 | Room temp. | Inv. Steel |
| A-9 | 1240 | 950 | 60 | 83 | 40 | Room temp. | Inv. Steel |
| B-1 | 1260 | 950 | 50 | 73 | 40 | Room temp. | Inv. Steel |
| B-2 | 1240 | 940 | 60 | 83 | <0.1 | 390 | Inv. Steel |
| B-3 | 1250 | 950 | 120 | 143 | <0.1 | 220 | Inv. Steel |
| B-4 | 1060 | 900 | 60 | 83 | 40 | Room temp. | Comp. Steel |
| B-5 | 1230 | 810 | 50 | 73 | 30 | Room temp. | Comp. Steel |
| B-6 | 1260 | 960 | 15 | 38 | 35 | Room temp. | Comp. Steel |
| B-7 | 1240 | 950 | 70 | 93 | 80 | Room temp. | Comp. Steel |
| B-8 | 1230 | 950 | 70 | 93 | <0.1 | 580 | Comp. Steel |
| B-9 | 1260 | 980 | 60 | 83 | 40 | Room temp. | Inv. Steel |
| B-10 | 1260 | 980 | 60 | 83 | 40 | Room temp. | Inv. Steel |
| C-1 | 1250 | 970 | 60 | 83 | 20 | Room temp. | Inv. Steel |
| D-1 | 1270 | 940 | 60 | 83 | 30 | Room temp. | Inv. Steel |
| E-1 | 1260 | 1030 | 70 | 93 | 20 | Room temp. | Inv. Steel |
| E-2 | 1250 | 1000 | 120 | 143 | <0.1 | 340 | Inv. Steel |
| E-3 | 1250 | 1020 | 100 | 123 | <0.1 | 240 | Inv. Steel |
| E-4 | 1060 | 910 | 60 | 83 | 40 | Room temp. | Comp. Steel |
| E-5 | 1240 | 950 | 120 | 143 | 100 | Room temp. | Comp. Steel |

TABLE 2-1-continued

| Steel | Temperature for heating slab (° C.) | Final rolling temperature (° C.) | Average cooling speed from final to 400° C. (° C./s) | Cooling speed from 550° C. to 400° C. (° C./s) | Maximum cooling speed at less than 400° C. (° C./s) | Coiling temperature (° C.) | Note |
|---|---|---|---|---|---|---|---|
| E-6 | 1260 | 1000 | 60 | 83 | 25 | Room temp. | Inv. Steel |
| E-7 | 1260 | 1000 | 60 | 83 | 25 | Room temp. | Inv. Steel |
| F-1 | 1240 | 920 | 60 | 83 | 30 | Room temp. | Inv. Steel |
| G-1 | 1300 | 950 | 50 | 73 | 40 | Room temp. | Inv. Steel |
| H-1 | 1250 | 930 | 60 | 83 | 30 | Room temp. | Inv. Steel |
| I-1 | 1260 | 960 | 50 | 73 | 20 | Room temp. | Inv. Steel |
| J-1 | 1250 | 950 | 80 | 103 | 35 | Room temp. | Inv. Steel |
| J-2 | 1270 | 970 | 60 | 83 | <0.1 | 390 | Inv. Steel |
| J-3 | 1230 | 960 | 120 | 143 | <0.1 | 220 | Inv. Steel |
| J-4 | 1090 | 900 | 90 | 113 | 40 | Room temp. | Comp. Steel |
| J-5 | 1240 | 830 | 50 | 73 | 35 | Room temp. | Comp. Steel |
| J-6 | 1250 | 920 | 10 | 33 | 20 | Room temp. | Comp. Steel |
| J-7 | 1230 | 950 | 70 | 93 | 90 | Room temp. | Comp. Steel |
| J-8 | 1260 | 930 | 80 | 103 | <0.1 | 620 | Comp. Steel |
| J-9 | 1230 | 940 | 70 | 93 | <0.1 | 350 | Inv. Steel |
| J-10 | 1230 | 940 | 70 | 93 | <0.1 | 350 | Inv. Steel |

Ranges beyond the present invention are underlined.

TABLE 2-2

| Steel | Temperature for heating slab (° C.) | Final rolling temperature (° C.) | Average cooling speed from final to 400° C. (° C./s) | Cooling speed from 550° C. to 400° C/s (° C./s) | Maximum cooling speed at less than 400° C. (° C./s) | Coiling temperature (° C.) | Note |
|---|---|---|---|---|---|---|---|
| K-1 | 1240 | 970 | 60 | 83 | 20 | Room temp. | Inv. Steel |
| L-1 | 1230 | 950 | 60 | 83 | 40 | Room temp. | Inv. Steel |
| M-1 | 1280 | 980 | 70 | 93 | 30 | Room temp. | Inv. Steel |
| M-2 | 1230 | 940 | 80 | 103 | <0.1 | 330 | Inv. Steel |
| M-3 | 1250 | 950 | 60 | 83 | <0.1 | 160 | Inv. Steel |
| M-4 | 1100 | 910 | 90 | 113 | 20 | Room temp. | Comp. Steel |
| M-5 | 1250 | 760 | 100 | 123 | 40 | Room temp. | Comp. Steel |
| M-6 | 1260 | 940 | 20 | 43 | 30 | Room temp. | Comp. Steel |
| M-7 | 1240 | 930 | 80 | 103 | 100 | Room temp. | Comp. Steel |
| M-8 | 1230 | 960 | 70 | 93 | <0.1 | 600 | Comp. Steel |
| M-9 | 1240 | 950 | 80 | 103 | <0.1 | 310 | Inv. Steel |
| M-10 | 1240 | 950 | 80 | 103 | <0.1 | 310 | Inv. Steel |
| N-1 | 1250 | 980 | 80 | 103 | 20 | Room temp. | Inv. Steel |
| O-1 | 1240 | 950 | 60 | 83 | 30 | Room temp. | Inv. Steel |
| P-1 | 1240 | 960 | 60 | 83 | 25 | Room temp. | Inv. Steel |
| Q-1 | 1240 | 940 | 60 | 83 | 40 | Room temp. | Inv. Steel |
| R-1 | 1260 | 950 | 70 | 93 | 30 | Room temp. | Inv. Steel |
| S-1 | 1230 | 970 | 80 | 103 | 20 | Room temp. | Inv. Steel |
| S-2 | 1220 | 980 | 60 | 83 | <0.1 | 360 | Inv. Steel |
| S-3 | 1270 | 940 | 80 | 103 | <0.1 | 200 | Inv. Steel |
| S-4 | 1060 | 950 | 70 | 93 | 30 | Room temp. | Comp. Steel |
| S-5 | 1230 | 830 | 150 | 173 | 20 | Room temp. | Comp. Steel |
| S-6 | 1250 | 960 | 10 | 33 | 20 | Room temp. | Comp. Steel |
| S-7 | 1230 | 970 | 70 | 93 | 120 | Room temp. | Comp. Steel |
| S-8 | 1280 | 960 | 80 | 103 | <0.1 | 290 | Inv. Steel |
| S-9 | 1270 | 950 | 80 | 103 | <0.1 | 290 | Inv. Steel |
| a-1 | 1210 | 920 | 60 | 83 | 20 | Room temp. | Comp. Steel |
| b-1 | 1260 | 950 | 80 | 103 | 25 | Room temp. | Comp. Steel |
| c-1 | 1240 | 940 | 60 | 83 | 20 | Room temp. | Comp. Steel |
| d-1 | 1230 | 930 | 70 | 93 | 20 | Room temp. | Comp. Steel |
| f-1 | 1250 | 1020 | 100 | 123 | 25 | Room temp. | Comp. Steel |
| g-1 | 1240 | 940 | 60 | 83 | 20 | Room temp. | Comp. Steel |
| h-1 | 1200 | 930 | 80 | 103 | 10 | Room temp. | Comp. Steel |
| i-1 | 1230 | 950 | 70 | 93 | 40 | Room temp. | Comp. Steel |
| j-1 | 1200 | 920 | 60 | 83 | 30 | Room temp. | Comp. Steel |
| k-1 | 1240 | 920 | 80 | 103 | 40 | Room temp. | Comp. Steel |

Ranges beyond the present invention are underlined.

TABLE 3-1

| Steel | Steel grade | Tempered martensite | Lower bainite | Balance | Other structures | Dislocation density $\times 10^{15}$ (l/m$^2$) | Number density of iron-based carbides $\times 10^6$ (l/mm$^2$) |
|---|---|---|---|---|---|---|---|
| A-1 | HR | 100 | 0 | 0 | — | 3.2 | 3.4 |
| A-2 | HR | 71 | 29 | 0 | — | 2.3 | 6.3 |
| A-3 | HR | 69 | 0 | 31 | Ferrite | 1.8 | 5.2 |
| A-4 | HR | 100 | 0 | 0 | — | 10.8 | 4.8 |
| A-5 | HR | 66 | 0 | 34 | Ferrite | 1.6 | 5.9 |
| A-6 | HR | 0 | 0 | 100 | Fresh martensite | 12.8 | 0.4 |
| A-7 | HR | 0 | 0 | 100 | Upper bainite | 0.8 | 0.8 |
| A-8 | GI | 100 | 0 | 0 | — | 3 | 4.5 |
| A-9 | GA | 100 | 0 | 0 | — | 2.6 | 6.8 |
| B-1 | HR | 98 | 0 | 2 | Ferrite | 2.9 | 3.7 |
| B-2 | HR | 25 | 75 | 0 | — | 1.6 | 3.9 |
| B-3 | HR | 88 | 12 | 0 | — | 2.5 | 6.9 |
| B-4 | HR | 66 | 0 | 34 | Ferrite | 1.8 | 4.2 |
| B-5 | HR | 100 | 0 | 0 | — | 10.3 | 4.8 |
| B-6 | HR | 27 | 0 | 73 | Ferrite | 0.8 | 4.3 |
| B-7 | HR | 0 | 0 | 100 | Fresh martensite | 21.3 | 0.9 |
| B-8 | HR | 0 | 0 | 100 | Ferrite and pearlite | 0.02 | 0.0 |
| B-9 | GI | 100 | 0 | 0 | — | 2.3 | 3.5 |
| B-10 | GA | 100 | 0 | 0 | — | 1.9 | 3.4 |
| C-1 | HR | 100 | 0 | 0 | — | 3.5 | 4.9 |
| D-1 | HR | 100 | 0 | 0 | — | 3.2 | 3.7 |
| E-1 | HR | 100 | 0 | 0 | — | 3.3 | 5.3 |
| E-2 | HR | 71 | 29 | 0 | — | 1.4 | 4.5 |
| B-3 | HR | 91 | 9 | 0 | — | 2.5 | 7.6 |
| E-4 | HR | 80 | 0 | 20 | Ferrite | 2.1 | 4.6 |
| E-5 | HR | 0 | 0 | 100 | Fresh martensite | 12.6 | 0.8 |
| E-6 | GI | 100 | 0 | 0 | — | 2.8 | 5.5 |
| E-7 | GA | 100 | 0 | 0 | — | 2.3 | 5.8 |
| F-1 | HR | 100 | 0 | 0 | — | 4.2 | 5.1 |
| G-1 | HR | 100 | 0 | 0 | — | 3.8 | 4.0 |
| H-1 | HR | 100 | 0 | 0 | — | 3.5 | 4.5 |
| I-1 | HR | 100 | 0 | 0 | — | 2.9 | 5.3 |
| J-1 | HR | 100 | 0 | 0 | — | 4.2 | 4.2 |
| J-2 | HR | 53 | 47 | 0 | — | 2.1 | 3.4 |
| J-3 | HR | 91 | 9 | 0 | — | 3.1 | 5.9 |
| J-4 | HR | 67 | 0 | 33 | Ferrite | 2.4 | 3.9 |
| J-5 | HR | 100 | 0 | 0 | — | 11.3 | 4.3 |
| J-6 | HR | 54 | 0 | 46 | Ferrite | 1.8 | 5.0 |
| J-7 | HR | 0 | 0 | 100 | Fresh martensite | 17.4 | 0.7 |
| J-8 | HR | 0 | 0 | 100 | Ferrite and pearlite | 0.02 | 0.0 |
| J-9 | GI | 70 | 30 | 0 | — | 1.9 | 5.1 |
| J-10 | GA | 70 | 30 | 0 | — | 1.4 | 4.6 |

| Steel | Effective crystal grain size (μm) | Aspect ratio | YP (MPa) | TS (MPa) | El (%) | vTrs (° C.) | BH (MPa) | Note |
|---|---|---|---|---|---|---|---|---|
| A-1 | 7.8 | 1.2 | 782 | 1023 | 12 | −60 | 170 | Inv. Steel |
| A-2 | 8.3 | 1.3 | 934 | 1007 | 13 | −70 | 110 | Inv. Steel |
| A-3 | 12.9 | 1.1 | 692 | 892 | 13 | 50 | 80 | Comp. Steel |
| A-4 | 5.5 | 2.3 | 957 | 1093 | 9 | 0 | 20 | Comp. Steel |
| A-5 | 7.2 | 1.4 | 705 | 924 | 14 | 30 | 40 | Comp. Steel |
| A-6 | 7.9 | 1.0 | 746 | 1057 | 9 | −20 | 20 | Comp. Steel |
| A-7 | 9.2 | 0.8 | 576 | 824 | 15 | −10 | 50 | Comp. Steel |
| A-8 | 7.7 | 1.0 | 852 | 998 | 14 | −50 | 140 | Inv. Steel |
| A-9 | 6.6 | 1.1 | 880 | 983 | 14 | −50 | 120 | Inv. Steel |
| B-1 | 6.5 | 1.1 | 769 | 1027 | 12 | −50 | 160 | Inv. Steel |
| B-2 | 7.2 | 1.3 | 882 | 1019 | 13 | −60 | 120 | Inv. Steel |
| B-3 | 6.5 | 1.0 | 949 | 1004 | 13 | −70 | 100 | Inv. Steel |
| B-4 | 12.7 | 1.2 | 672 | 867 | 14 | 30 | 90 | Comp. Steel |
| B-5 | 4.8 | 2.5 | 912 | 1055 | 10 | −20 | 10 | Comp. Steel |
| B-6 | 6.4 | 1.1 | 558 | 792 | 18 | −30 | 40 | Comp. Steel |
| B-7 | 5.1 | 0.9 | 752 | 1093 | 9 | 0 | 25 | Comp. Steel |
| B-8 | 7.4 | 1.2 | 736 | 842 | 15 | −10 | 20 | Comp. Steel |
| B-9 | 6.7 | 1.0 | 899 | 1002 | 14 | −50 | 120 | Inv. Steel |
| B-10 | 6.7 | 1.1 | 948 | 984 | 14 | −50 | 100 | Inv. Steel |
| C-1 | 6.3 | 1.0 | 773 | 1035 | 13 | −50 | 150 | Inv. Steel |
| D-1 | 6.5 | 1.3 | 781 | 1042 | 12 | −40 | 160 | Inv. Steel |
| E-1 | 5.9 | 0.9 | 762 | 1026 | 12 | −50 | 140 | Inv. Steel |
| E-2 | 7.3 | 0.9 | 934 | 989 | 14 | −50 | 110 | Inv. Steel |
| B-3 | 6.8 | 1.0 | 862 | 1007 | 13 | −60 | 100 | Inv. Steel |
| E-4 | 11.6 | 1.8 | 816 | 923 | 13 | 0 | 80 | Comp. Steel |
| E-5 | 6.7 | 1.2 | 843 | 1092 | 11 | 20 | 50 | Comp. Steel |
| E-6 | 6.1 | 1.0 | 879 | 1021 | 13 | −50 | 130 | Inv. Steel |

TABLE 3-1-continued

| | | | | | | | | |
|---|---|---|---|---|---|---|---|---|
| E-7 | 6.0 | 1.1 | 924 | 991 | 13 | −50 | 110 | Inv. Steel |
| F-1 | 5.7 | 1.3 | 749 | 1042 | 12 | −40 | 150 | Inv. Steel |
| G-1 | 7.3 | 1.1 | 761 | 1006 | 13 | −50 | 160 | Inv. Steel |
| H-1 | 7.9 | 1.5 | 782 | 1124 | 13 | −50 | 150 | Inv. Steel |
| I-1 | 7.1 | 1.0 | 781 | 1019 | 14 | −40 | 130 | Inv. Steel |
| J-1 | 6.0 | 1.1 | 746 | 1047 | 12 | −60 | 150 | Inv. Steel |
| J-2 | 7.5 | 0.9 | 873 | 1007 | 14 | −50 | 110 | Inv. Steel |
| J-3 | 6.4 | 1.1 | 972 | 1026 | 13 | −70 | 90 | Inv. Steel |
| J-4 | 11.9 | 0.9 | 624 | 842 | 15 | 30 | 60 | Comp. Steel |
| J-5 | 3.8 | 2.1 | 924 | 1072 | 9 | −30 | 20 | Comp. Steel |
| J-6 | 5.3 | 1.7 | 643 | 879 | 17 | −20 | 50 | Comp. Steel |
| J-7 | 6.5 | 1.0 | 806 | 1112 | 8 | −10 | 25 | Comp. Steel |
| J-8 | 8.1 | 1.4 | 887 | 935 | 14 | −50 | 30 | Comp. Steel |
| J-9 | 6.8 | 0.9 | 910 | 1031 | 13 | −50 | 120 | Inv. Steel |
| J-10 | 6.9 | 0.9 | 948 | 1018 | 13 | −50 | 100 | Inv. Steel |

HR represents hot-rolled steel sheet,
GI represents hot-dip-galvanized steel sheet,
GA represents galvannealed steel sheet.
Ranges beyond the present invention are underlined.

TABLE 3-2

| Steel | Steel grade | Tempered martensite | Lower bainite | Balance | Other structures | Dislocation density $\times 10^{15}$ (l/m$^2$) | Number density of iron-based carbides $\times 10^6$ (l/mm$^2$) |
|---|---|---|---|---|---|---|---|
| K-1 | HR | 100 | 0 | 0 | — | 3.4 | 6.3 |
| L-1 | HR | 100 | 0 | 0 | — | 4.2 | 7.4 |
| M-1 | HR | 100 | 0 | 0 | — | 3.8 | 8.2 |
| M-2 | HR | 67 | 33 | 0 | — | 1.9 | 10.4 |
| M-3 | HR | 95 | 5 | 0 | — | 3.9 | 4.2 |
| M-4 | HR | 72 | 0 | 28 | Ferrite | 2.7 | 7.2 |
| M-5 | HR | 100 | 0 | 0 | — | 11.9 | 8.4 |
| M-6 | HR | 64 | 36 | 0 | — | 1.5 | 9.5 |
| M-7 | HR | 0 | 0 | 100 | Fresh martensite | 19.6 | 0.9 |
| M-8 | HR | 0 | 0 | 100 | Ferrite and pearlite | 0.02 | 0.0 |
| M-9 | GI | 72 | 28 | 0 | — | 2.5 | 8.3 |
| M-10 | GA | 72 | 28 | 0 | — | 1.3 | 8.1 |
| N-1 | HR | 100 | 0 | 0 | — | 4.1 | 10.4 |
| O-1 | HR | 100 | 0 | 0 | — | 4.0 | 8.9 |
| P-1 | HR | 100 | 0 | 0 | — | 3.8 | 10.6 |
| Q-1 | HR | 100 | 0 | 0 | — | 4.3 | 16.2 |
| R-1 | HR | 100 | 0 | 0 | — | 4.5 | 17.5 |
| S-1 | HR | 100 | 0 | 0 | — | 3.5 | 19.5 |
| S-2 | HR | 33 | 67 | 0 | — | 1.7 | 22.6 |
| S-3 | HR | 87 | 13 | 0 | — | 2.8 | 16.8 |
| S-4 | HR | 73 | 0 | 27 | Ferrite | 0.01 | 15.6 |
| S-5 | HR | 100 | 0 | 0 | — | 10.3 | 16.7 |
| S-6 | HR | 83 | 0 | 17 | Ferrite | 2.6 | 18.3 |
| S-7 | HR | 0 | 0 | 100 | Fresh martensite | 18.3 | 0.3 |
| S-8 | GI | 68 | 32 | 0 | — | 3.4 | 13.9 |
| S-9 | GA | 68 | 32 | 0 | — | 1.1 | 12.1 |
| a-1 | HR | 0 | 0 | 100 | Ferrite | 0.01 | 0.0 |
| b-1 | HR | 91 | 0 | 9 | Retained austenite | 32.5 | 0.4 |
| c-1 | HR | 84 | 0 | 16 | Ferrite | 3.1 | 2.1 |
| d-1 | HR | 100 | 0 | 0 | — | 12.1 | 0.9 |
| f-1 | HR | 100 | 0 | 0 | — | 2.9 | 3.9 |
| g-1 | HR | 100 | 0 | 0 | — | 4.2 | 4.2 |
| h-1 | HR | 66 | 0 | 34 | Ferrite | 2.3 | 3.7 |
| i-1 | HR | 100 | 0 | 0 | — | 3.1 | 4.0 |
| j-1 | HR | 100 | 0 | 0 | — | 3.5 | 3.9 |
| k-1 | HR | 100 | 0 | 0 | — | 4.2 | 4.5 |

| Steel | Effective crystal grain size (μm) | Aspect ratio | YP (MPa) | TS (MPa) | El (%) | vTrs (° C.) | BH (MPa) | Note |
|---|---|---|---|---|---|---|---|---|
| K-1 | 6.6 | 0.8 | 802 | 1046 | 12 | −50 | 100 | Inv. Steel |
| L-1 | 7.9 | 1.1 | 945 | 1208 | 11 | −40 | 130 | Inv. Steel |
| M-1 | 6.3 | 0.8 | 947 | 1231 | 10 | −40 | 120 | Inv. Steel |
| M-2 | 7.2 | 1.1 | 1108 | 1193 | 11 | −50 | 140 | Inv. Steel |
| M-3 | 6.6 | 1.0 | 1078 | 1210 | 10 | −60 | 100 | Inv. Steel |
| M-4 | 12.2 | 0.9 | 692 | 963 | 12 | 0 | 70 | Comp. Steel |
| M-5 | 3.2 | 4.3 | 997 | 1309 | 6 | −20 | 20 | Comp. Steel |
| M-6 | 6.2 | 1.0 | 849 | 942 | 13 | 20 | 50 | Comp. Steel |

TABLE 3-2-continued

| | | | | | | | | |
|---|---|---|---|---|---|---|---|---|
| M-7 | 6.3 | 1.4 | 962 | 1324 | 7 | −20 | 20 | Comp. Steel |
| M-8 | 8.4 | 1.2 | 948 | 973 | 15 | −30 | 10 | Comp. Steel |
| M-9 | 7.0 | 1.0 | 1088 | 1172 | 13 | −50 | 120 | Inv. Steel |
| M-10 | 7.1 | 1.0 | 1128 | 1152 | 12 | −50 | 100 | Inv. Steel |
| N-1 | 8.2 | 1.1 | 960 | 1223 | 12 | −60 | 120 | Inv. Steel |
| O-1 | 8.3 | 1.2 | 951 | 1242 | 12 | −60 | 110 | Inv. Steel |
| P-1 | 6.4 | 1.1 | 976 | 1199 | 13 | −60 | 140 | Inv. Steel |
| Q-1 | 6.7 | 1.0 | 1076 | 1372 | 11 | −60 | 130 | Inv. Steel |
| R-1 | 8.9 | 1.2 | 1069 | 1381 | 11 | −50 | 110 | Inv. Steel |
| S-1 | 5.8 | 0.9 | 1168 | 1530 | 9 | −40 | 100 | Inv. Steel |
| S-2 | 6.9 | 1.0 | 1384 | 1473 | 10 | −60 | 120 | Inv. Steel |
| S-3 | 5.9 | 1.2 | 1286 | 1503 | 9 | −50 | 110 | Inv. Steel |
| S-4 | 10.8 | 1.1 | 862 | 1372 | 8 | −20 | 60 | Comp. Steel |
| S-5 | 3.9 | 2.9 | 1386 | 1603 | 4 | −30 | 40 | Comp. Steel |
| S-6 | 6.2 | 1.2 | 903 | 1402 | 8 | −10 | 50 | Comp. Steel |
| S-7 | 6.5 | 1.1 | 1032 | 1638 | 6 | −10 | 50 | Comp. Steel |
| S-8 | 6.5 | 1.0 | 1385 | 1492 | 10 | −50 | 120 | Inv. Steel |
| S-9 | 6.5 | 1.1 | 1421 | 1470 | 11 | −50 | 100 | Inv. Steel |
| a-1 | 16.2 | 1.4 | 330 | 462 | 34 | −80 | 0 | Comp. Steel |
| b-1 | 3.8 | 1.2 | 1826 | 2429 | 4 | 60 | 90 | Comp. Steel |
| c-1 | 5.4 | 1.0 | 892 | 1086 | 14 | 0 | 120 | Comp. Steel |
| d-1 | 4.9 | 1.1 | 926 | 1118 | 11 | −20 | 80 | Comp. Steel |
| f-1 | 6.4 | 0.8 | 826 | 1031 | 8 | 0 | 120 | Comp. Steel |
| g-1 | 5.9 | 1.2 | 842 | 1007 | 9 | −10 | 130 | Comp. Steel |
| h-1 | 5.0 | 1.2 | 501 | 832 | 15 | −20 | 80 | Comp. Steel |
| i-1 | 6.2 | 1.1 | 792 | 1042 | 13 | −30 | 210 | Comp. Steel |
| j-1 | 13.2 | 1.5 | 803 | 1038 | 12 | −10 | 100 | Comp. Steel |
| k-1 | 3.2 | 1.4 | 783 | 1019 | 13 | −10 | 120 | Comp. Steel |

HR represents hot-rolled steel sheet,
GI represents hot-dip-galvanized steel sheet,
GA represents galvannealed steel sheet
Ranges beyond the present invention are underlined.

The invention claimed is:

1. A high-strength hot-rolled steel sheet with a tensile strength of 980 MPa or more, the steel sheet having a composition consisting of, in mass %, C: 0.01% to 0.2%,
Si: 0% to 2.5%,
Mn: 0% to 4.0%,
Al: 0% to 2.0%,
N: 0% to 0.01%,
Cu: 0% to 2.0%,
Ni: 0% to 2.0%,
Mo: 0% to 1.0%,
V: 0% to 0.3%,
Cr: 0% to 2.0%,
Mg: 0% to 0.01%,
Ca: 0% to 0.01%,
REM: 0% to 0.1%,
B: 0% to 0.01%,
P: less than or equal to 0.10%,
S: less than or equal to 0.03%,
O: less than or equal to 0.01%,
one or both of Ti and Nb: 0.01% to 0.30% in total, and
the balance being Fe and inevitable impurities, wherein the steel sheet has a structure in which a total volume fraction of one or both of tempered martensite and lower bainite is 90% or more, the steel sheet has a structure in which a total volume fraction of tempered martensite is 53% or more and a total volume fraction of lower bainite is 47% or less, the steel sheet has a thickness of less than 10 mm, the one or both of tempered martensite and lower bainite have an effective crystal size of less than or equal to 10 μm, the aspect ratio of effective crystal grains of the tempered martensite and bainite is 2 or less, and a dislocation density in the martensite and lower bainite is greater than or equal to $5\times10^{13}$ ($1/m^2$) and less than or equal to $1\times10^{16}$ ($1/m^2$).

2. The high-strength hot-rolled steel sheet according to claim 1, wherein the one or both of tempered martensite and lower bainite include $1\times10^6$ (numbers/$mm^2$) or more iron-based carbides.

3. The high-strength hot-rolled steel sheet according to claim 1, wherein one or more of, in mass %, Cu: 0.01% to 2.0%,
Ni: 0.01% to 2.0%,
Mo: 0.01% to 1.0%,
V: 0.01% to 0.3%, and
Cr: 0.01% to 2.0%
is part of the composition of the steel sheet.

4. The high-strength hot-rolled steel sheet according to claim 1, wherein one or more of, in mass %, Mg: 0.0005% to 0.01%,
Ca: 0.0005% to 0.01%, and
REM: 0.0005% to 0.1%
is part of the composition of the steel sheet.

5. The high-strength hot-rolled steel sheet according to claim 1, wherein B is in an amount of 0.0002% to 0.01% in mass %.

6. A method for producing a high-strength hot-rolled steel sheet according to claim 1, the method comprising:

heating, optionally after cooling, a casting slab to a temperature of 1220° C. or more, the casting slab having a composition consisting of, in mass %, C: 0.01% to 0.2%,
Si: 0% to 2.5%,
Mn: 0% to 4.0%,
Al: 0% to 2.0%,
N: 0% to 0.01%,
Cu: 0% to 2.0%,
Ni: 0% to 2.0%,
Mo: 0% to 1.0%,
V: 0% to 0.3%,
Cr: 0% to 2.0%,
Mg: 0% to 0.01%, Ca: 0% to 0.01%,
REM: 0% to 0.1%,
B: 0% to 0.01%,
P: less than or equal to 0.10%,
S: less than or equal to 0.03%,
O: less than or equal to 0.01%,
one or both of Ti and Nb: 0.01% to 0.30% in total, and the balance being Fe and inevitable impurities;
completing hot rolling at a temperature of 900° C. or more;
cooling the steel sheet at a cooling speed of 50° C./s or more on average from a final rolling temperature to 400° C.;
setting a cooling speed of not more than 50° C./s at a temperature of less than 400° C.; and
coiling the steel sheet.

7. The method for producing a high-strength hot-rolled steel sheet according to claim 6, further comprising:
performing galvanizing treatment or galvannealing treatment.

* * * * *